US005815057A

United States Patent [19]

Hoffman et al.

[11] Patent Number: 5,815,057

[45] Date of Patent: Sep. 29, 1998

[54] ELECTRONICALLY CONTROLLED SWITCHING DEVICE

[75] Inventors: Jerzy Hoffman, Las Vegas, Nev.; John L. Wenger, Salisbury, Md.

[73] Assignee: K & L Microwave Incorporated, Salisbury, Md.

[21] Appl. No.: 650,105

[22] Filed: May 17, 1996

[51] Int. Cl.[6] ..... H01H 53/00

[52] U.S. Cl. ..... 335/4; 335/78; 335/82; 335/179

[58] Field of Search ..... 335/4, 5, 78–86, 335/124, 128, 177–79; 333/103–7

[56] References Cited

U.S. PATENT DOCUMENTS

| | | |
|---|---|---|
| 2,140,604 | 12/1938 | Snavely . |
| 2,919,323 | 12/1959 | Drescher . |
| 4,122,420 | 10/1978 | Brown . |
| 4,150,348 | 4/1979 | Foltz . |
| 4,191,937 | 3/1980 | Koehler et al. . |
| 4,260,159 | 4/1981 | Hoffman . |
| 4,298,847 | 11/1981 | Hoffman . |
| 4,392,398 | 7/1983 | Hoffman . |
| 4,560,966 | 12/1985 | Nagamoto et al. . |
| 4,581,597 | 4/1986 | Walley . |
| 4,633,201 | 12/1986 | Ruff ..... 335/4 |
| 4,646,043 | 2/1987 | Hoffman . |
| 4,697,056 | 9/1987 | Hoffman . |
| 4,749,967 | 6/1988 | Hoffman et al. . |
| 4,795,994 | 1/1989 | Hoffman . |
| 4,908,588 | 3/1990 | Hoffman et al. . |
| 4,978,935 | 12/1990 | Hoffman et al . |
| 5,047,740 | 9/1991 | Alman . |
| 5,227,750 | 7/1993 | Connell et al. . |
| 5,272,458 | 12/1993 | Hoffman et al. . |
| 5,315,273 | 5/1994 | Blair et al. . |

*Primary Examiner*—Lincoln Donovan
*Attorney, Agent, or Firm*—Banner & Witcoff, Ltd.

[57] ABSTRACT

An electromagnetic switching device for controlling the flow of electrical current between a plurality of pins. The switching device includes a base, an input pin, first and second output pins, a reed, an actuator, a magnetic field generator, and generator pins. The reed and actuators are movable between a first position which electrically couples the first output pin and the input pin, and a second position which electrically couples the second output pin and the input pin. Dielectric compatible plastic material with enhanced shielding characteristics is located in apertures in the base to structurally retain the pins therein. The actuator further includes a center body portion, an arm integrally molded with the center body portion extending generally laterally outward therefrom, and a finger depending downwardly from the arm. The finger is structurally coupled to the movable reed to move the reed between its first and second positions. The magnetic field generator includes a hollow centrally-located sleeve and a coil wound around the sleeve. The tip member of the actuator is positioned within the hollow sleeve for movement along a longitudinal center axis. The magnetic field generator further includes mechanical connectors attached to a respective end of the coil to frictionally receive a respective generator pin and electrically connect the pins with their respective end of the coil. Application of current to the coil creates a magnetic field forcing the tip member in a predetermined direction, which moves the actuator, with its tip member, from one of its first and second positions to the other of its first and second positions. A mounting adapter positioned at the lower side of the base permits easy conversion of a pin-through switch to a surface-mount switch.

37 Claims, 10 Drawing Sheets

ELECTRONICALLY CONTROLLED SWITCHING DEVICE

FIELD OF THE INVENTION

The present invention relates to a switching device for controlling the flow of electricity between a plurality of terminals. More specifically, the present invention relates to a high-speed, high-reliability, electronically controlled switching device which utilizes a magnetic field generator and an actuator to control the flow of electricity between terminals in DC power and high-frequency electronic systems.

BACKGROUND OF THE INVENTION

Previous electromagnetic switching devices for controlling the flow of electrical current between a plurality of terminals utilize a relatively large electromagnet and an armature having a permanent magnet or a ferromagnetic member. The electromagnet includes a stationary soft iron or steel core, a yoke, and a coil wound around the core. When current is applied to the coil, the stationary core becomes strongly magnetized and moves the armature to a desired position. The stationary core becomes almost completely demagnetized when the current is interrupted. Some examples of these previous electromagnetic switching devices are disclosed in U.S. Pat. Nos. 5,315,273, 4,978,935, and 4,795,994. However, many previous electromagnetic switching devices include various drawbacks.

For example, some electronic switching devices include a large number of moving parts. This increases the susceptibility to failure especially if the device requires a large number of operating cycles or if the device is used under certain conditions including extreme vibration, acceleration, or temperature conditions. This also typically increases the amount of labor required to assemble the device, therefore increasing its assembly cost. Further, a large number of moving parts in the device also typically requires tighter part tolerances, which in turn, increases the part and assembly costs. Additionally, many of these devices are also labor intensive to assemble, requiring numerous soldering steps and/or a large number of interfitting parts. This can result in a higher per unit cost and/or lower reliability. Accordingly, a switching device which reduces the number of moving parts and has a simplified assembly process was thus needed.

Additionally, the trend in electronics is to make electronic components smaller and more efficient. However, many of the prior switching devices are sized and configured in a manner which is undesirable for use in many present applications. The size of the electromagnet, the size of the armature, and the spacing between the electromagnet and the armature occupy significant volume and prevent the utilization of such switching devices in applications demanding smaller volume components. Further, the actuation speed of the switching device is limited due to inherent qualities and characteristics of the electromagnet. Therefore, a more compact, high-speed, high-reliability switching device was needed.

Further, existing switching devices typically include rigid pin conductors extending from their lower end. These pin conductors are inserted through holes in a circuit board and are soldered thereto. Specially designed switching devices also exist which include mounting tabs extending from the lower sides thereof permitting the switching device to be surface-mounted to a circuit board. However, the pin-mount and surface mount devices have been different in design and in manufacture resulting in increased costs and unnecessary parallel inventory for the manufacturer. A device which permits the same basic switching design to be used in pin-mount and surface-mount applications with only minor modifications was thus needed.

Many existing switching devices, especially switching devices used in high-frequency systems, e.g., RF, lack the ability to obtain exceptional switching reliability. This is in part due to RF leakage into and/or from the switching device through its base. In many present designs, the pins are placed through holes in the base and liquified glass is poured into the holes. Upon cooling, the glass acts as a dielectric and retains the pin conductors in the holes in the base. However, the use of glass may not be wholly acceptable in some applications where enhanced RF shielding is desired. It was therefore needed to provide a switching device having an enhanced shielding arrangement for the base while providing an exceptional arrangement for fixedly retaining the pin conductors in the base.

The present invention was designed to overcome these and other disadvantages, and to provide an improved switching device.

SUMMARY OF THE INVENTION

In view of the foregoing, it is a principal object of the present invention to provide an improved switching device for controlling the flow of electrical current between a plurality of terminals in DC Power, RF and other high-frequency electronic systems.

More specifically, it is an object of the invention to provide a switching device which utilizes a compact drive mechanism allowing the overall switch package to have a reduced volume.

It is an also an object of the invention to provide a switching device which can mechanically interface to any system, e.g., direct-wire, surface-mount, or through-pin connection.

Further, it is an object of the invention to provide a switching device which can operate as either a fail-safe switch or a latching switch with only a slight modification thereto.

Another object is to provide a switching device which has enhanced reliability, enhanced operating performance and which facilitates assembly.

These and other objects are achieved by the present invention which, according to one aspect, provides an electrically-controlled, electromagnetic switching device for controlling the flow of electrical current between a plurality of terminals. The switching device includes an input terminal, first and second output terminals, a contact element, an actuator, and a magnetic field generator. The contact element is movable between a first position which electrically couples the first output terminal and the input terminal, and a second position which electrically couples the second output terminal and the input terminal. The actuator includes a body with a permanent magnet and a ferromagnetic tip member movable with and structurally coupled to the body by a magnetic attraction force. The actuator is structurally coupled to the contact element and is movable between a first position which moves the contact element to its first position and a second position which moves the contact element to its second position. The magnetic field generator includes a hollow centrally-located sleeve and a coil wound around the sleeve in a predetermined direction. The hollow sleeve has a longitudinal center axis and the tip member of the actuator is positioned within the hollow sleeve for movement along the longitudinal center axis. Application of electrical current to the coil creates a magnetic field forcing the tip member in a predetermined direction, which moves the actuator, with its tip member, from one of its first and second positions to the other of its first and second positions.

In yet another aspect, the invention provides an electrically-controlled, electromagnetic switching device for controlling the flow of electrical current between terminals. The switch includes a base, an input pin, first and second output pins, a movable reed, an actuator, and a magnetic field generator. The input, first output, and second output pins are fixedly mounted substantially perpendicular to the base. The movable reed is electrically coupled to the input pin and is movable between a first position wherein the first output pin is electrically coupled to the input pin, and a second position wherein the second output pin is electrically coupled to the input pin. The actuator includes a center body portion, a permanent magnet attached to the center body portion, an arm integrally molded with the center body portion extending generally laterally outward therefrom, and a finger depending downwardly from the arm. The finger is structurally coupled to the movable reed. The actuator is movable between first and second positions and is structurally coupled to the movable reed such that the reed is in its first position when the actuator is in its first position and the reed is in its second position when the actuator is in its second position. The magnetic field generator has a hollow centrally located sleeve and a coil wound around the sleeve in a predetermined direction. The application of electrical current through the coil creates a magnetic field moving the actuator from its first position to its second position.

In another aspect, the invention provides an electrically-controlled, electromagnetic switching device for controlling the flow of electrical current between a plurality of terminals. The switching device includes a base, input, first output and second output terminals extending through the base, a contact element, an actuator, a magnetic field generator, first and second plugs, and first and second receptacles. The contact element is movable between a first position which electrically couples the first output terminal and the input terminal, and a second position which electrically couples the second output terminal and the input terminal. The actuator includes a ferromagnetic portion and is fixedly coupled to the movable contact element to move the contact element between the first and second positions. The magnetic field generator includes a sleeve having an outer surface and upper and lower ends, an upper flange extending laterally outward from the sleeve at the upper end, a lower flange extending laterally outward from the sleeve at the lower end, and a coil having first and second ends. The coil is wound around the outer surface of the sleeve between the upper and lower flanges in a predetermined direction. The first and second plugs extend through the base. The receptacles are attached to a respective end of the coil and frictionally receive a respective plug to electrically connect the plug with its respective end of the coil. Electrical current applied to first plug travels to the second plug, via the coil, creating a magnetic field to move the actuator from its first position to its second position.

In another aspect, the invention provides a switching device for controlling the flow of electrical current between a plurality of terminals. The switching device includes a base, electrically conductive input, first output, and second output shafts, a switching mechanism, and a mounting adapter. The base includes a lower side, an upper side, and a plurality of apertures therein. Each shaft extends through a respective aperture, and is attached and electrically insulated with respect to the base. The switching mechanism electrically couples the first output shaft and the input shaft when under a first set of predetermined conditions and electrically couples the second output shaft and the input shaft when under a second set of predetermined conditions. The mounting adapter is positioned at the lower side of the base and has a body including a plurality of apertures, and mounting members extending from the body. Each aperture in the mounting adapter body is superimposed below a respective aperture in the base. The mounting members include a mounting portion permitting the surface mounting of the switching device, and a spacing portion vertically offsetting the mounting portion with respect to the body. The shafts extend through a respective aperture in the mounting adapter body, are affixed with respect to the mounting adapter body, and are electrically coupled to a respective mounting member.

The present invention also provides a switching device for controlling the flow of electrical current between a plurality of terminals. The switching device includes a base having a plurality of apertures, electrically conductive input, first output, and second output shafts extending through a respective aperture in the base, and a switching mechanism electrically coupling the first output shaft and the input shaft when under a first set of predetermined conditions and electrically coupling the second output shaft and the input shaft when under a second set of predetermined conditions. Dielectric compatible plastic material is located in the apertures which (i) structurally retain the shafts therein, (ii) prevent undesired movement of the shafts with respect to the base, and (iii) electrically insulate the shafts with respect to the base.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
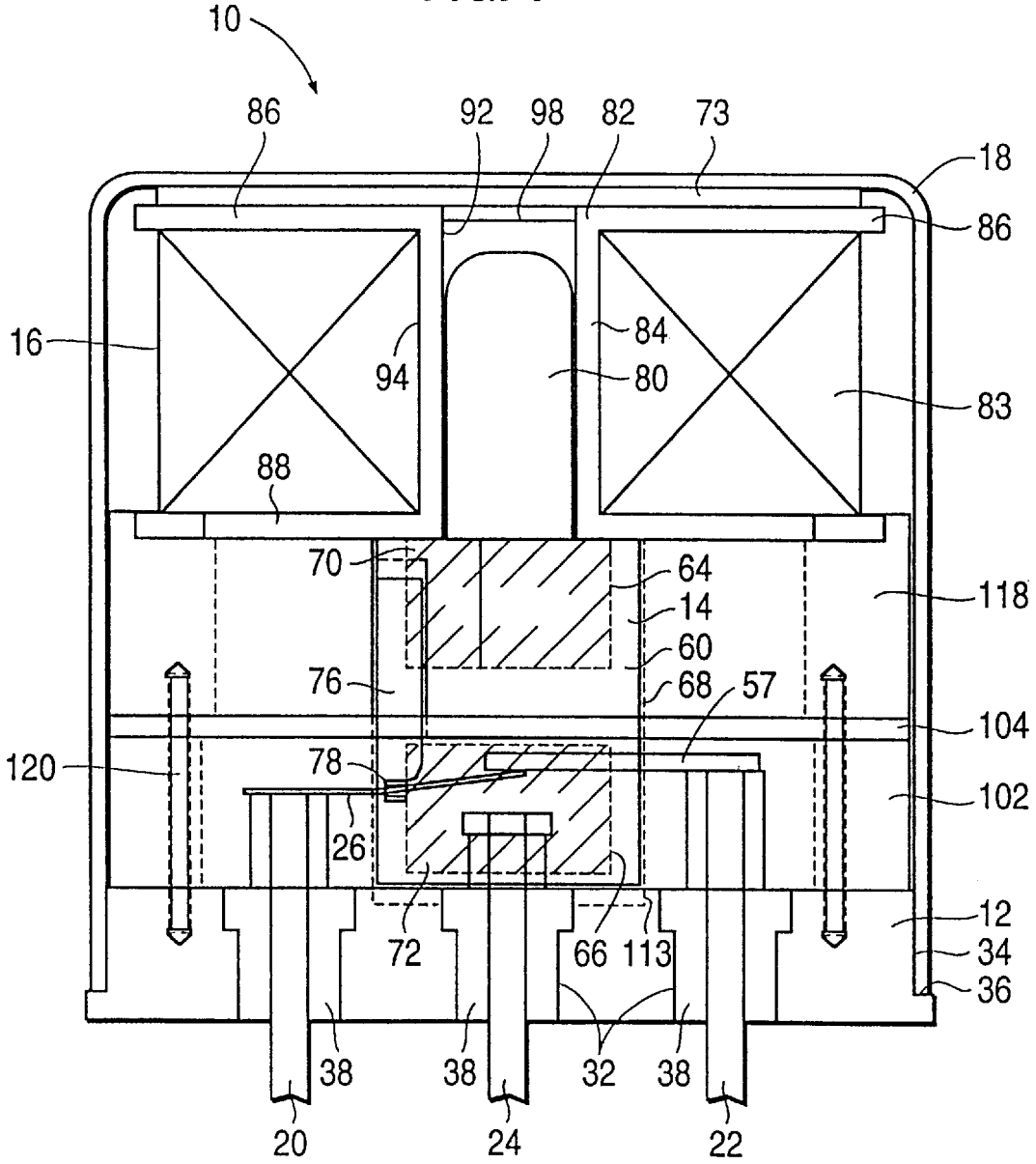
FIG. 1 is a schematic cross-sectional view of a latched switch of the present invention, with the actuator shown in a first position.

In the present invention, as pictured in FIGS. 1–13, preferred switching devices for controlling the flow of electrical current between a plurality of terminals in DC Power, RF, and other high frequency electronic systems, are designated generally by reference numerals 10, 300, 400, and 600. At the outset, it should be noted that many aspects of the present invention are primarily directed for use as electrically controlled switches, e.g., relays. However, it should be noted that many aspects of the present invention need not be limited to relays and are applicable to other devices. For the purposes of simplicity and consistency, the specification will refer to switching device 10 as a relay.

Figure 2:
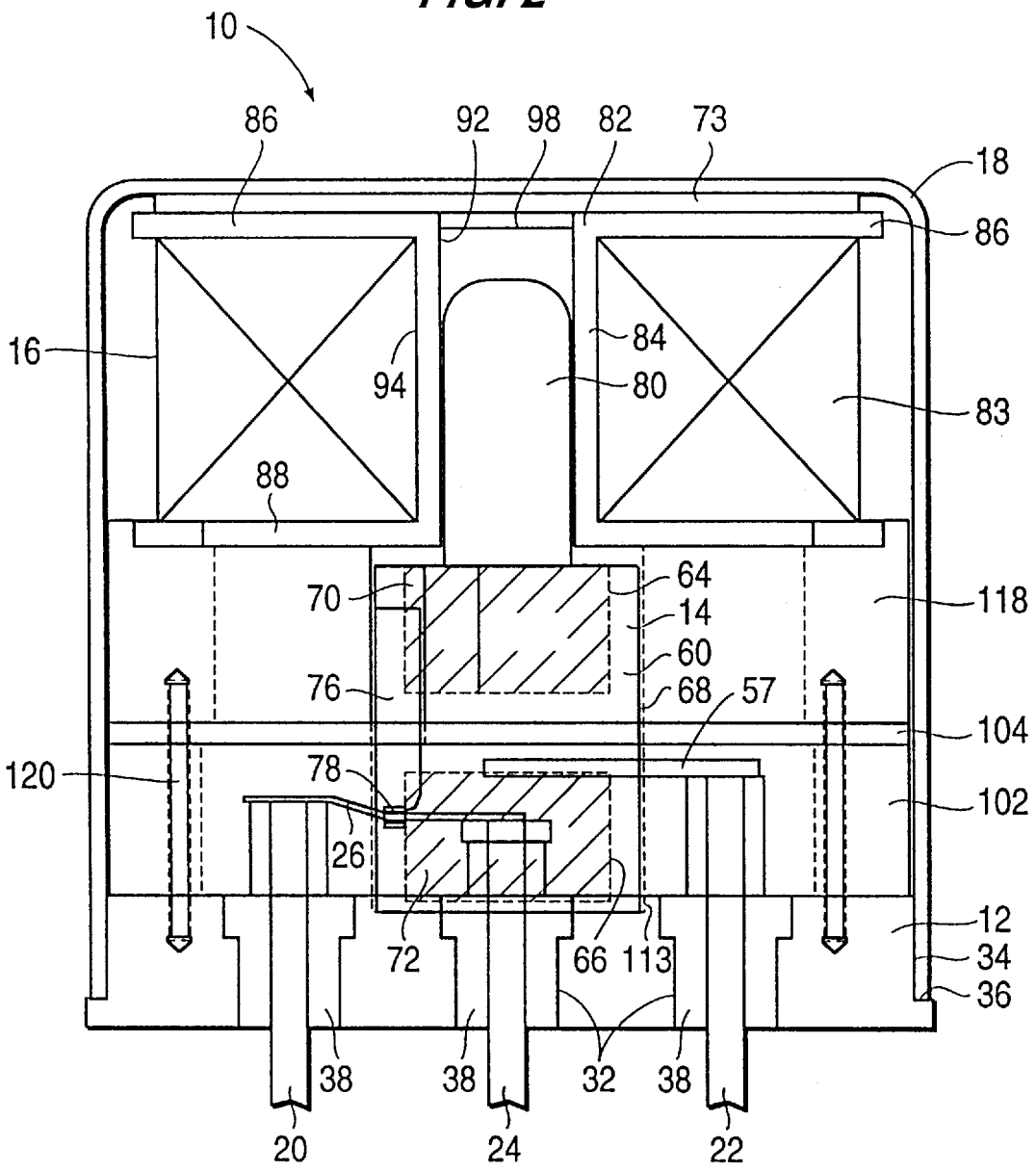
FIG. 2 is a schematic cross-sectional view of the switch of FIG. 1, with the actuator shown in a second position.

As schematically shown in FIGS. 1–2 and 6–7, in sum, relay 10 preferably includes a base 12, an actuator 14, a magnetic field generator 16, and a can or shell 18. An input terminal 20, a first output terminal 22, and a second output terminal 24 extend through the base 12 and into the inner region of the relay 10 encased between the base 12 and the can 18. A movable contact element 26, structurally coupled to the actuator 14, electrically connects the input pin 20 and the first output pin 22 when the actuator 14 is in a first position, as shown in FIG. 1, and electrically connects the input pin 20 and the second output pin 24 when the actuator 14 is in a second position, as shown in FIG. 2. Magnetic field generator 16 is preferably powered by direct electrical current from power supply terminals or pins 28 and 30, shown in FIGS. 3 and 4, to create a desired magnetic field. The actuator 14 is responsive to the magnetic field created by generator 16 and to one or more biasing members to move the actuator 14 between the first and second positions, and to retain the actuator 14 in at least one of the positions in the absence of a magnetic field generated by generator 16.

Figure 3:
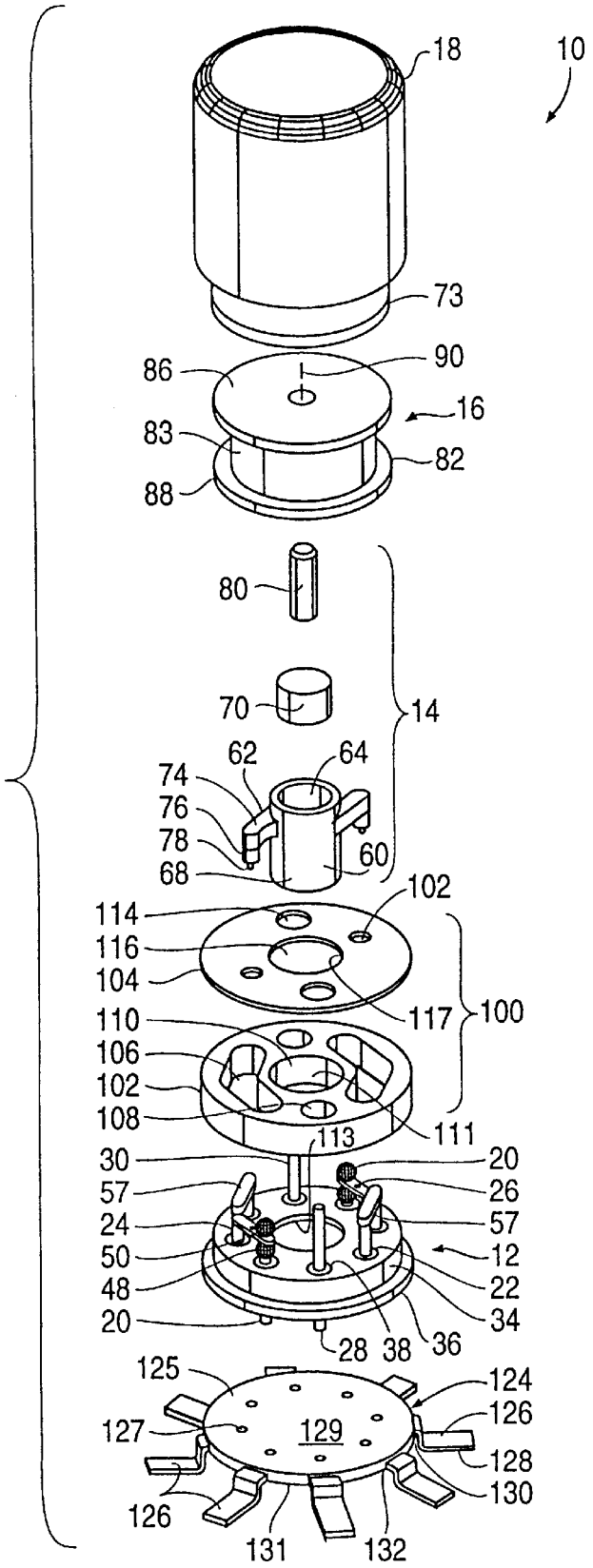
FIG. 3 is an exploded perspective view of the switch of FIG. 1.

The relay 10 shown in FIGS. 1–3 is of the "latched" variety, i.e., its actuator 10 will remain either the first or the second position in the absence of an applied magnetic field generated by generator 16. Thus, this arrangement produces a relay having changeover contacts. The relay 300 shown in FIGS. 6–7, as will be understood from the description hereinafter, is of the "fail-safe" variety, i.e., its actuator 14 will remain in only one designated position in the absence of an applied magnetic field generated by generator 16. Thus, relay 300 has either normally open contacts or normally closed contacts.

Additionally, the relays 10, 300, 400, and 600 shown in FIGS. 1–13 include two sets of switching contacts, i.e., they are double pole switches. However, it is apparent that the relays of the present invention can include only one set of switching contacts, i.e., a single pole switch, or more than two sets of switching pole contacts.

Referring specifically to FIGS. 1–5, the base 12 of relay 10 includes an annular outer surface 34, an annular outwardly extending flange 36, and a plurality of angularly spaced apertures 32 therein. The annular outer surface 34 and annular outwardly extending flange 36 provide mating surfaces for press-fitting the lower end of the can 18 to enclose the mechanism of the relay therewithin. Further, this arrangement facilitates the ability to weld the can 18 to the base 12 hermetically sealing the inner mechanism of the relay 10 from the environment.

Figure 4:
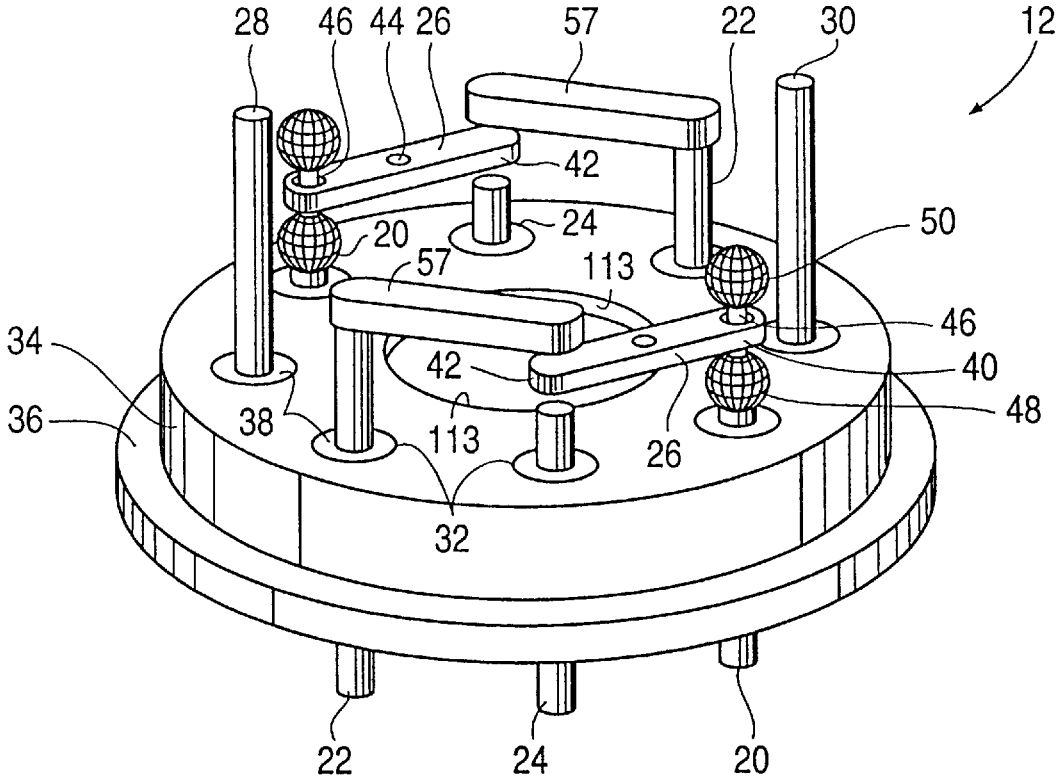
FIG. 4 is a perspective view of the base, reed, and electrical contact assembly.

As shown in FIG. 4, the pins 28 and 30 for the magnetic field generator 16 and the pins of the controlled circuit, i.e., the input terminal or pin 20 and output terminals or pins 22 and 24, extend from below the base 12 through the apertures 32 and into the inner region of relay 10. The pins 20, 22, 24, 28, and 30 are structurally retained in the apertures 32 by dielectric compatible plastic material 38 preventing undesired movement and electrically insulating the pins from the base 12. The dielectric compatible plastic material 38 located in the apertures 32 preferably has a dielectric constant in the range between 3.0 and 3.5 to provide enhanced dielectric properties compared to glass, which has a dielectric constant in the range between 5 and 10. In a preferred arrangement, the position of the pins 20, 22, 24, 28, and 30 are held stable relative to the apertures 32 and the base 12, and dielectric compatible plastic material 38 in a liquid form is poured into the aperture, and upon curing, fills the apertures 32 and accomplishes the above noted functions. One preferred and commercially available dielectric plastic material is polyphenylene sulfide.

Further, in the latching relay 10 of FIGS. 1–5, the base 12 is either preferably made from a metallic or ferromagnetic material, includes an upper portion or coating with a metallic or ferromagnetic material, or includes a centrally located metallic or ferromagnetic member. As will be evident from the description hereinafter, this material, in combination with a lower permanent magnet, creates a downward biasing force permitting the actuator 14 to latch in its second or lower position.

Figure 5:
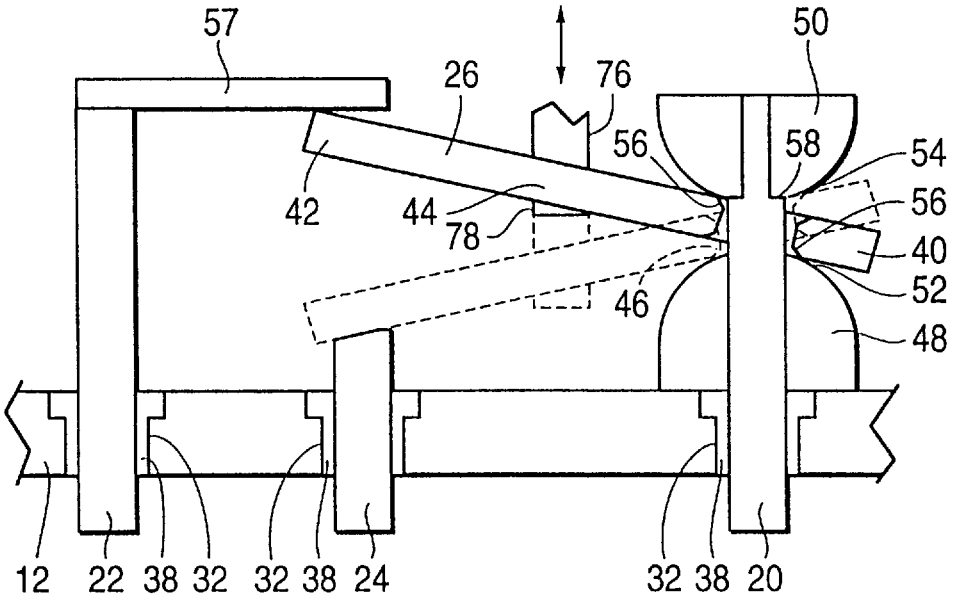
FIG. 5 is a side elevational view of the pin and reed assembly with the reed depicted in a first position by solid line and in a second position by broken line.

As illustrated in FIGS. 3–5, a contact element or reed 26 is movable between a first position, shown in solid line, where the reed 26 couples the first output pin 22 and the input pin 20, and a second position, shown in broken line, which electrically couples the second output pin 24 and the input pin 20. More specifically, reed 26 includes a first end 40, a second end 42, and a center section 44. The first end 40 has an aperture 46 therein which is loosely captured between electrically conductive lower and upper shoulders 48 and 50 on the input pin 20. As depicted in FIG. 5, the lower and upper shoulders 48 and 50 include upper and lower convex spherical or ellipsoidal surfaces 52 and 54 respectively, which contact the reed 26 on opposing sides of the aperture 46 when it reaches one of its extreme positions. The surfaces of the lower and upper shoulders 48 and 50 not facing the reed 26, i.e., the lower surface of the lower shoulder 48 and the upper surface of the upper shoulder 50, may be any desired shape and is not critical to the operation of the relay 10.

To obtain more accuracy and assembly benefits, the input pin 20 includes a stop or a reduced diameter portion 58 which permits the desired tolerance between the shoulders 48 and 50 to be obtained in a simple assembly step. The lower and upper shoulders 48 and 50 may be welded or affixed to pin 20 by a spot weld or any other desired manner.

The reed 26 includes a breaking edge 56 or tapered section at the top and bottom of its aperture 46. Further, the gap between the shoulders 48 and 50 is larger than the thickness of the reed 26. These features permit the reed 26 to move between its positions and make reliable electrical contact with both of the shoulder 48 and 50. Further, this arrangement eliminates virtually all of the stresses on reed 26 because the reed 26 can "free float" at its first end 40 and still maintain proper electrical contact with the input pin 20. Further, this arrangement also permits a design having larger tolerances. Also, the spherical or ellipsoidal surfaces on the shoulders 48 and 50 are frictionally engaged by the reed 26 to perform a cleaning type function to enhance electrical continuity. Further, this arrangement is also has reliability and operating speed benefits because the reed 26 does not have to overcome internal bending stresses as it moves between its positions.

Additionally, as seen in FIG. 5, the first output pin 22 includes a generally horizontal contact extension 57 which is perpendicular to the first output pin 22 and is attached at the end thereof, preferably by welding. Contact extension 57 has a distal portion which is substantially superimposed above the top of the second output pin 24 such that the second end 42 of the reed 26 contacts the superimposed portions at its extreme positions.

Figure 8:
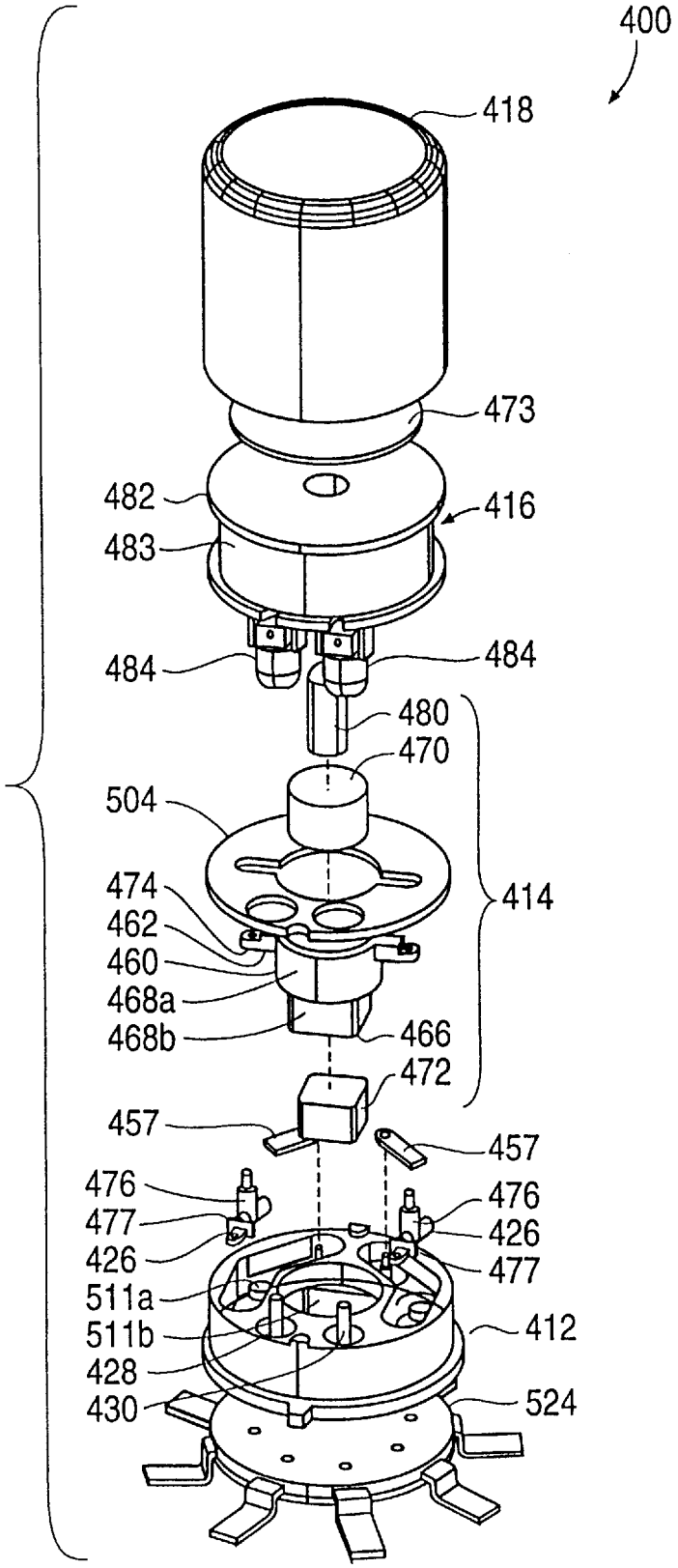
FIG. 8 is an exploded perspective view of a switch, similar to that shown in FIG. 3, including a few modifications thereto.

The reed 26, preferably at its center section 44, is coupled to the actuator 14 so that it moves in accordance with the position of the actuator 14. The coupling between the reed 26 and the actuator 14 is preferably a loose coupling which causes the reed 26 to move between its positions with the movement of the actuator 14 but does not create any bending stresses in the reed 26 or in the actuator 14. One arrangement for obtaining this relationship can be a pin and slot arrangement as shown in FIG. 8.

As illustrated in FIGS. 1–3, the actuator 14 includes a center body portion 60, a guiding member or tip element 80, e.g., a plunger, and one or more outwardly extending members 62 depending upon the number of circuits being controlled. The center body portion 60 is preferably primarily made from a plastic or non-ferrous material and includes an upper compartment 64, a lower compartment 66, and an outer surface 68 which is guided during its reciprocatory movement. Upper and lower permanent magnets 70 and 72 are fixed within the upper and lower compartments 64 and 66, respectively, which permits the biasing or latching of the actuator 14. In a preferred embodiment, the permanent magnets 70 and 72 are molded within the compartments 64 and 66 to eliminate subsequent assembly steps. As described in further detail hereinafter, the upper permanent magnet 70 is attracted to a metal or ferromagnetic plate 73, while the lower permanent magnet 72 is attracted to a metal or ferromagnetic portion of the base 12.

As the embodiment shown in FIG. 3 includes two sets of circuits being controlled, i.e., two sets of input, first output, and second output pins 20, 22, and 24, two outwardly extending members 62 are utilized. Each member 62 includes a generally outwardly depending arm 74, the distal end of each includes a downwardly depending finger 76. The lower end of each finger 76 is coupled to the reed 26 as described above or in any other desirable manner.

Figure 9:
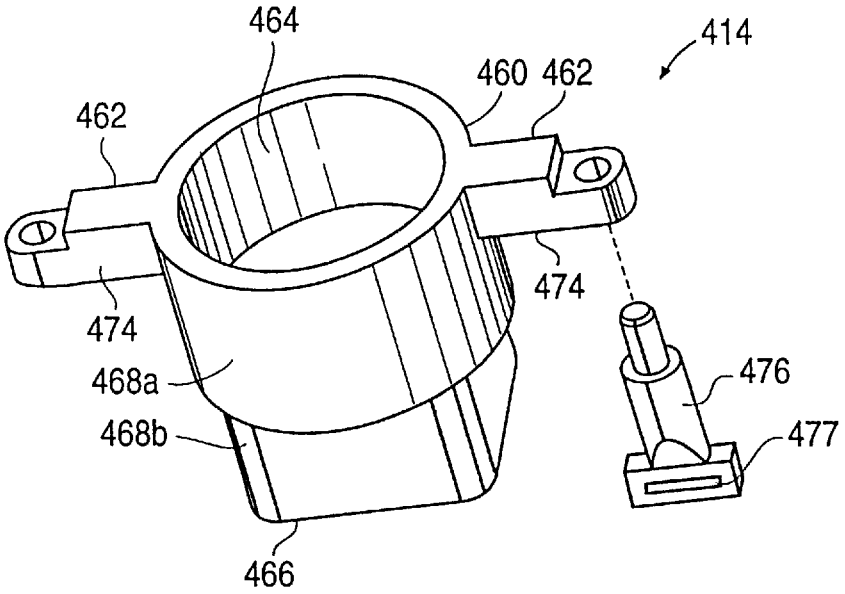
FIG. 9 is an enlarged perspective view of the actuator illustrated in FIG. 8.

In one preferred embodiment, the center body portion 60, the arms 74, and the fingers 76 are integrally molded as a single piece to reduce part and assembly costs. However, it is possible to integrally mold the center body portion 60 and the arms 74 together, and couple the fingers 76 to the arms 74 in a separate step, as is shown in FIG. 9.

The plunger 80, which preferably includes kovar or iron, is movable with and structurally coupled to the upper portion of the body 60 only by a magnetic attraction force between the plunger 80 and the upper permanent magnet 70. Thus, the plunger 80 is movable with the actuator 14 as it moves between its upper or first position, as shown in FIG. 1, and its lower or second position, as shown in FIG. 2. The plunger 80 travels within inside of the magnetic field generator 16 to reduce the overall dimensions of the relay 10, and preferably extends about 75% of the way into the hollow sleeve 84.

The magnetic field generator 16 substantially includes a bobbin 82 and a coil 83 wound around the bobbin 82. More specifically, the bobbin 82 includes a hollow center core or sleeve 84 and upper and lower flanges 86 and 88 at the top and bottom thereof. The hollow sleeve 84 has a longitudinal axis 90, an inner wall surface 92, and an outer wall surface 94. The coil 83 is wound around the outer wall surface 92 of hollow sleeve 84 between flanges 86 and 88. The bobbin 82 is comprised of a substantially non-ferrous material, e.g., plastic, aluminum. Further, magnetic field generator 16 is substantially void of a stationary ferromagnetic member in its hollow sleeve 84.

The plunger 80 is positioned within the inner wall 92 of hollow sleeve 84 for movement along the longitudinal center axis. The coil 83 includes first and seconds ends, not shown, which are electrically coupled and attached to pins 28 and 30, by soldering or any known technique, so that current supplied to the coil from the pins 28 and 30 creates a magnetic field based upon known electromagnetic principles. The generated magnetic field forces the actuator 14 in a predetermined direction depending upon the direction of the current, which moves the actuator, with its plunger 80, from one of its said first and second positions to the other of its said first and second positions. In the latched relay of FIGS. 1–3, the direction of the magnetic field will be dependent upon which magnetic field generator pin 28 or 30 is providing the current. Conventional circuit logic, not shown, is used to reverse the direction of the supplied current, i.e., the polarity of the coil 83, after each energization.

The ferromagnetic plate 73 is positioned between the top of the upper flange 88 of bobbin 40882 and the underside of the can 18. This plate 73, in combination with the upper 70 and plunger 80, creates a upward biasing force permitting the actuator 14 to latch in its first or upper position. Optionally, and for assembly purposes only, plate 73 may include a downwardly extending projection 98 for alignment purposes with bobbin 82. However, it is recognized that the plunger 80 can be glued to inside of the top of can 18 in lieu of, or in addition to, alignment projection 98. Further, plate 73 can be eliminated if the center portion of can 18 is made from a ferromagnetic material to provide the desired attraction force with upper permanent magnet 70. It should be noted that the alignment projection 98 need only extend into the hollow core 84 a minimal amount to produce the alignment benefits, e.g., 0.020 inches, and that in the preferred embodiment, the magnetic field generator 16 remains substantially void of a stationary ferromagnetic member in its hollow sleeve 84.

An RF shield assembly 100 is located above the base 12 and includes an RF cavity 102 and an RF cover 104. As illustrated in FIG. 3, RF cavity 102 and RF cover 104 include, respectively, superimposed apertures or holes 108 and 114 for generator pins 28 and 30 and superimposed apertures or holes 110 and 116 providing respective internal surfaces 111 and 117 for guiding the outer guided surface 68 of the center body 60 of the actuator 14 as it moves between its first and second positions. The base 12 also preferably includes a guiding surface 113 therein, superimposed with the guiding surfaces 111 and 117, to further guide the outer guided surface 68 of the actuator 14.

RF cavity 102 further includes apertures 106 therein, each of which houses a contact assembly including the switching circuit pins 20, 22, and 24, the reed 26, and a portion of the downwardly depending finger 78 coupled to the reed 26. The RF shield 104 includes a hole or aperture 112 permitting the actuator finger 76 to extend therethrough into the aperture 106 of the RF cavity 102.

The shield assembly 100 including the RF cavity 102 and the RF cover 104 is comprised of any material providing favorable RF shielding benefits, or in the alternative, can be made from any suitable material and plated to provide the desired RF shielding benefits. For example, in a preferred arrangement, the RF cavity 102 and the cover 104 can be made of aluminum, or of a ceramic material and plated. Thus, in either preferred arrangement, the RF cavity and cover 102 and 104 are comprised of an outer metallic surface to create a predetermined impedance which is preferably chosen as a function of the predetermined characteristics of the contact element. If relay 10 is intended for use in non-RF applications or in other applications where shielding is not necessary, RF shield 100 can be comprised of any desired material.

If desired, relay 10 may include an upper spacer 118, shown in FIGS. 1–2, to provide alignment, spacing, and assembly benefits with respect to the base 12, the RF shield assembly 100 and the bobbin 82. If used, assembly guide pins 120 would also preferably be used to properly position the elements with respect to each other. Further, necessary accommodations, e.g., bore holes would also be used in the elements to accommodate the assembly guide pins 120.

The pins 20, 22, 24, 28, and 30 of relay 10 permit pin-through circuit board mounting by known processes, e.g., where the pins of the relay 10 are inserted into corresponding holes in a circuit board and are soldered thereto. Relay 10 can also be used in a surface-mount application by the incorporation of a surface mount adapter 124. The surface mount adapter 124 is attached immediately below the base 12 and includes a central body portion 125 with its upper surface 129 positioned adjacent the bottom of the base 12, and a plurality of mounting members or tabs 126, extending generally radially from said body portion 125. Each mounting tab 126 includes a surface mounting portion 128 permitting the surface mounting of the switching device, and a vertical spacing or offsetting portion 130, vertically offsetting said mounting portion 128 with respect to the lower side 131 of the central body portion 125, to prevent solder from waking in.

The central body portion 125 includes a plurality of apertures 127 therein, corresponding to, and superimposed below, the apertures 32 in base 12. Each pin also extends through a respective aperture 127 in the mounting adapter central body portion 125. Each mounting tab 126 corresponds to a pin 20, 22, 24, 28, and 30, is electrically coupled thereto, and is electrically isolated from adjacent mounting tabs 126. In a preferred embodiment, the mounting tabs 126 include a pin connecting section 132, extending from the top of the vertical offsetting portion 130, which is molded into the central body portion 125 between the upper surface 129 and the lower surface 131. The pin connecting section 132 extends toward the aperture region where it preferably extends into or lines the inside surface of its respective aperture 127. Each pin is preferably fixedly and electrically attached to its respective mounting tab 126 by a weld in its aperture 127 from its underside or lower surface. Any extra pin length extending from the lower surface 131 of body portion 125 can be severed if necessary to permit the surface-mounting of relay 10.

In operation, assume initially that the latching relay 10 is in the state as shown in FIG. 1, i.e., the upper or first position, with the coil 83 in a non-energized state, i.e., where no current is applied thereto. The upward biasing force due to the magnetic flux between the upper permanent magnet 70 and plunger 80, and the plate 73, is greater than the attraction or downward biasing force due to the magnetic flux between the lower permanent magnet 72 and the base 12, due to their relative spacings. Actually, the plunger 80 becomes an extension to upper magnet 70 by conducting flux therethrough and attracting plate 73. This retains the actuator 14 and its reed 26 in the first position in absence of an electrical current applied to coil 83, and the input pin 20 will remain electrically coupled to the first output pin 22.

Application of electrical current through the correct one of the pins 28 and 30, e.g., pin 28, to coil 83 creates a magnetic field which tends to force the plunger 80, with the rest of the actuator 14, and the reed 26 downward from the first position to the second position. The magnitude of the force created by the energization need only overcome the resultant upward biasing force, i.e., the upward biasing force created by upper magnet 70, plunger 80 and plate 73 minus the downward biasing force created by lower magnet 72 and base 12, to move the actuator 14 and the reed 26 to their lower position, as shown in FIG. 2.

As the actuator 14 moves downward, the upward biasing force due to the magnetic flux between the upper permanent magnet 70, the plunger 80, and the plate 73, decreases and the downward biasing force due to the magnetic flux between the lower permanent magnet 72 and the base 12, increases, due to their relative spacings. Accordingly, the magnitude of the resultant biasing force which was directionally upward and at a maximum magnitude will decrease as the actuator 14 moves downward. Continued downward motion of the actuator 14 will occur due to the energization of coil 83 until the resultant force becomes directionally downward, i.e., until the downward biasing force created by upper magnet 70, plunger 80 and plate 73 exceeds the upward biasing force created by lower magnet 72 and base 12. Maximum magnitude of the downward resultant biasing force will occur when the actuator 14 reaches its second position.

Based on scientific principles, it is evident that moving the actuator 14 from its upper position to its lower position requires only a magnetic field created by coil 83 sufficient to move the actuator to a position where the resultant biasing force is downward. Accordingly, the magnetic field produced by the coil 83 need only be produced instantaneously to move the actuator to its position where the downward biasing force exceeds the upward biasing force. Further, because plunger 80 is comprised from a normally magnetic-neutral material, as opposed to a strongly magnetized material, it is easier and takes less power to apply a sufficient magnetic force thereto to move actuator 14.

When the actuator 14 reaches its lower or second position, the reed 26 will electrically couple the input pin 20 and the second output pin 24. The actuator 14 and its reed 26 will remain in the second position in absence of an electrical current applied to coil 83, until some outside influence alters this state.

To return the actuator 14 to its first position, the polarity of power supplied to the coil is reversed by the circuity as described above. The flux generated by the coil 83 now compliments the direction of the upward biasing force. Thus, application of electrical current through the other pin 30 to coil 83 creates a magnetic field which forces the plunger 80, with the rest of the actuator 14 and the reed 26, upward from the second position to the first position. In a similar manner, the magnitude of the force created by the energization need only overcome the resultant downward biasing force to move the actuator 14 and the reed 26 back to their upper position, as shown in FIG. 1. The actuator 14 will remain latched in this position until the next energization of coil 83.

It should be noted that through this operation, the magnetic attraction force between the upper magnet 70 and the plunger 80 exceeds the other forces applied to the upper magnet 70 and the plunger 80 which would tend to separate them. This assures that the upper magnet 70 and the plunger 80 will always remain magnetically coupled and no mechanical attachment mechanism is required to obtain this function. This arrangement permits lateral movement of the plunger 80 with respect to the upper magnet 70, and therefore reduces wear between the plunger 80 and the inner wall surface 92 of the bobbin 84. Further, because lateral movement of the plunger 80 with respect to the upper magnet 70 is permitted, the relative tolerances between (i) the plunger 80 and the inner wall surface 92 of the bobbin 84, and (ii) the outer guided surface 68 of the actuator 14 and the guiding surfaces 111, 113, and 117, can be less stringent and still obtain excellent reliability.

Further, numerous advantages may be obtained by the fact that the plunger 80 moves significantly within the centrally located hollow bobbin core 84 and that the wound coil 83 does not require a stationary iron or steel core therein. First, as the plunger 80 of the movable actuator is already located inside the wound coil 83, a magnetic field sufficient to move the actuator 14 can quickly be obtained with a generally instantaneous application of current to the coil 83, as opposed to an electromagnet which relies on the magnetization of a stationary core and the attraction between the stationary core and a movable actuator spaced a distance from the core. Additionally, because the actuator 14 utilizes the space inside the hollow core 84, the relay 10 can be made having a smaller volume. Further, because all of the primary forces acting on the actuator 14 are located substantially along its central axis, the actuator 14 will tend to wear less and provide smoother motions. Other advantages not specifically listed may also be inherent due to these elements and this configuration.

Figure 6:
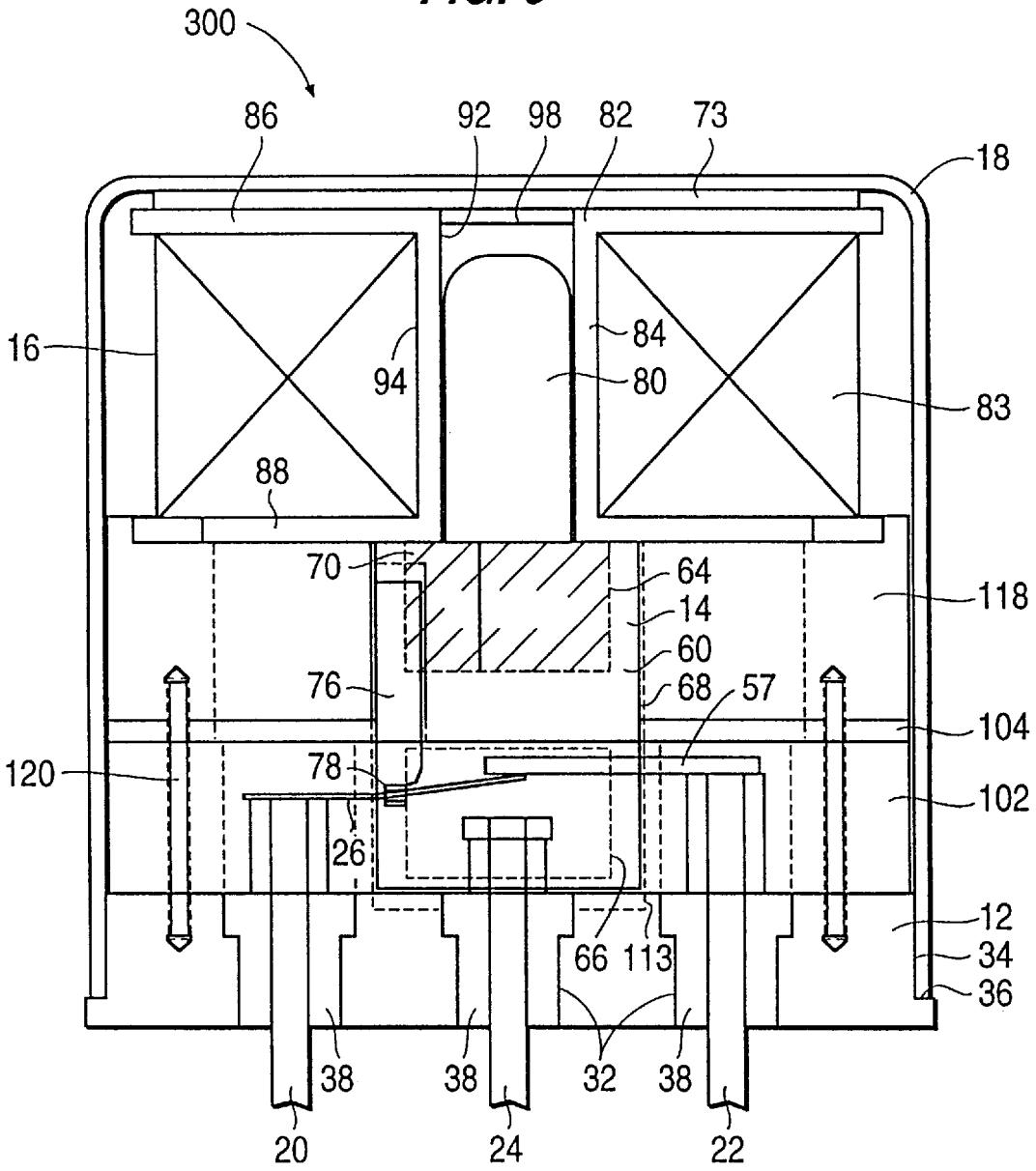
FIG. 6 is a schematic cross-sectional view of a fail-safe switch of the present invention, with the actuator shown in a first position.
Figure 7:
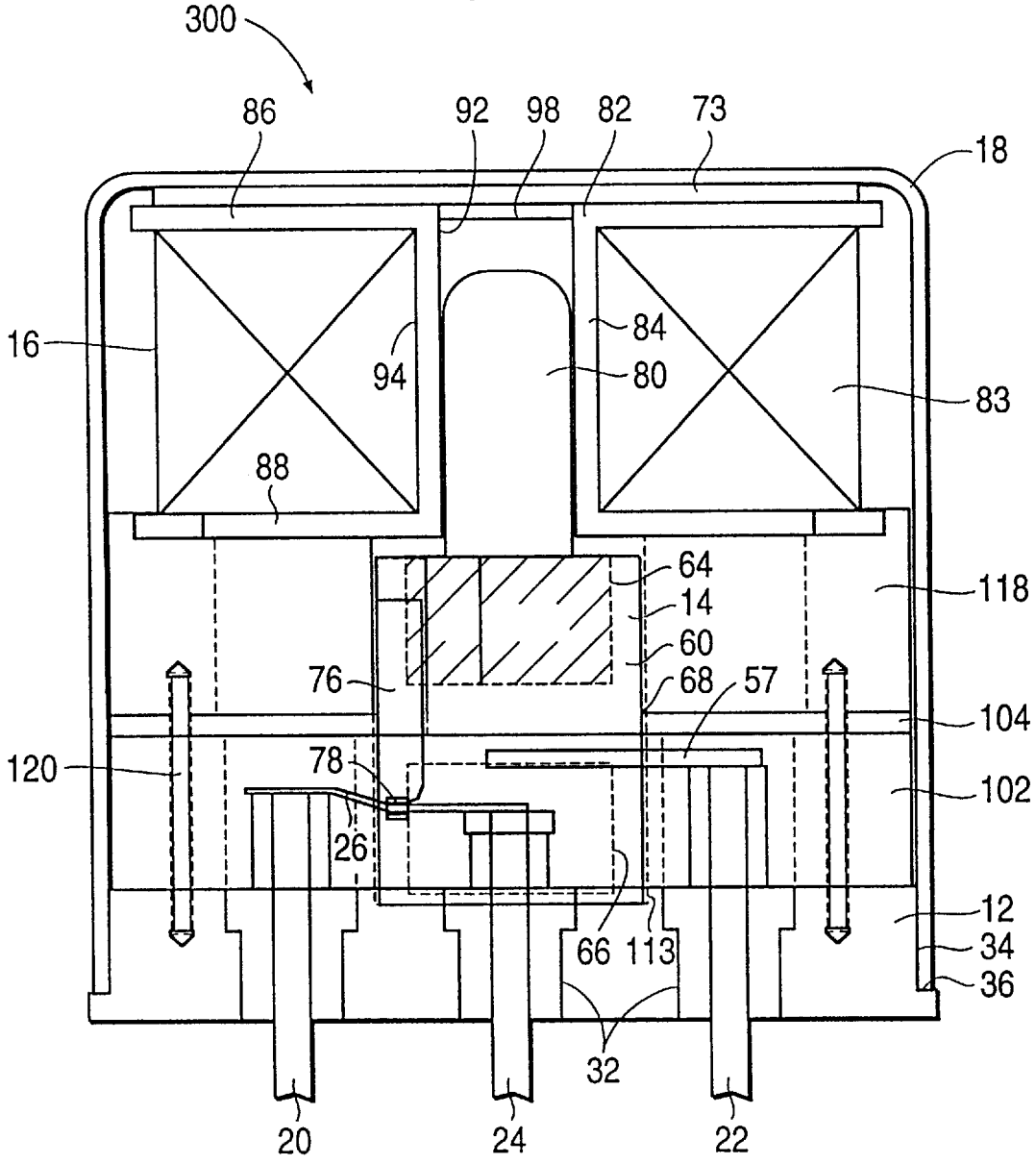
FIG. 7 is a schematic cross-sectional view of the switch of FIG. 6 with the actuator shown in a second position.

The fail-safe relay 300 of FIG. 6 and 7 is similar to the latching relay 10 of FIGS. 1–2, differing in that it does not include lower magnet 68 or a ferromagnetic portion in base 12. In effect, the exclusion of one or both of these elements removes the downward biasing force. Thus, the resultant biasing force is always equal to the upward biasing force created by the upper permanent magnet 70, the plunger 80 and the plate 73. This permits the relay 300 to be designed to be of the "normally-open" or "normally-closed" type. Further, no conventional circuit logic is necessary to reverse the direction of the supplied current, as the current will only be applied to one end of the coil, i.e., the polarity of the coil 83 does not need to be reversed between energizations.

In operation, assume initially that the latching relay 10 is in the state as shown in FIG. 6, i.e., the first position, with the coil 83 in a non-energized state, i.e., where no current is applied thereto. As there is no downward biasing, the actuator 14 is latched in this state by the actuator's combined attraction to the armature plate 73. Thus, there is only an upward biasing, and the actuator 14 and its reed 26 will be retained in the first position in absence of an electrical current applied to coil 83. Thus, the input pin 20 will remain electrically coupled to the first output pin 22.

Application of electrical current through the predetermined pin 28 or 30, e.g., pin 28, to coil 83 creates a magnetic field which tends to force the plunger 80, with the rest of the actuator 14 and the reed 26, downward from the first position to the second position. The magnitude of the force created by the energization is sufficient to overcome the upward biasing force created by upper magnet 70, the plunger 80 and plate 73 to move the actuator 14 and the reed 26 to their lower position, as shown in FIG. 7. Accordingly, this action changes the state of all connections within the switch assembly. The continued application of current to coil 83 is necessary to retain actuator 14 in its second position, i.e., the magnetic field generator 16 must remain energized.

When the magnetic field generator 16 becomes non-energized by removing the current to coil 83, the only significant force on the actuator 14 is the upward biasing force and actuator 14 returns to its original and non-energized state as shown in FIG. 6. Thus, the permanent magnet 70 extended by plunger 80, and the plate 73 creates a magnetically induced force therebetween sufficient to move the actuator 14 from its second position to its first position and to retain the actuator 14 in its first position in the absence of electrical current being applied to coil 83.

Figure 10:
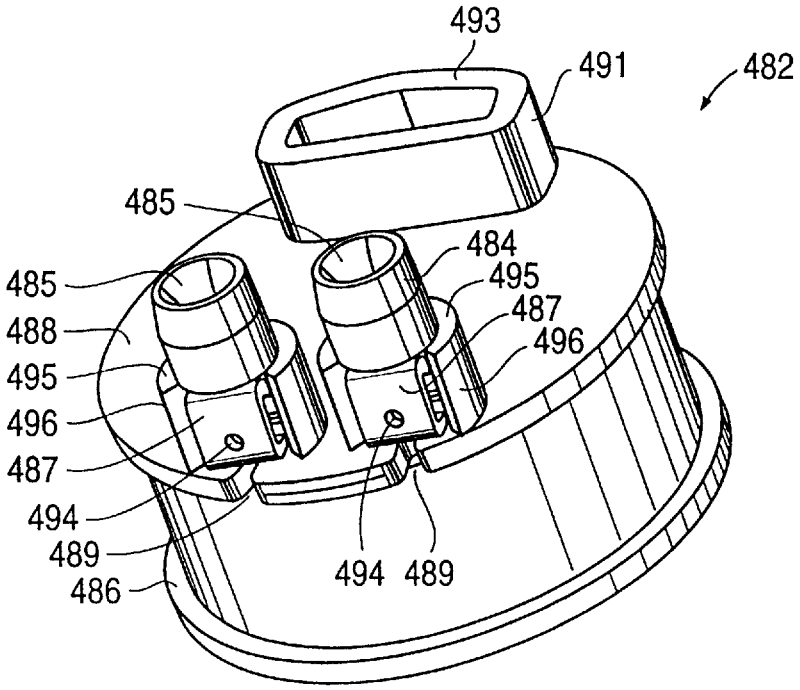
FIG. 10 is and enlarged perspective view of the underside of the bobbin illustrated in FIG. 8 showing the mechanical pin connectors and the spacer.

The relay 600, as shown in FIGS. 8–10 is similar to the relays shown in FIGS. 1–7 showing some alternative arrangements and some features in more detail. For example, relay 400 preferably includes a can 418, a plate 473, a magnetic field generator 416, an actuator 414, a plunger 480, and a base 412, and can utilize a surface adapter plate 524 for surface mounting applications. It should be noted that any or all of the features of this relay may be incorporated into the other relays described herein, and any or all of the features of any of the other relays described herein may be incorporated into this relay. For example, relay 400 is shown as including upper and lower permanent magnets in the actuator body, i.e., latched. However, it is recognized that the lower permanent magnet can be excluded to achieve a "fail-safe" relay in a manner as described above.

As shown in FIGS. 8 and 9, actuator 414 includes a center body portion 460 with an upper compartment 464 for housing an upper permanent magnet 470, a lower compartment 466 for housing lower permanent magnet 472, and upper and lower outer guided surfaces 468*a* and 468*b*. As shown in FIG. 8, these guided surfaces 468*a* and 468*b* are guided by respective guide surfaces 511*a* and 511*b* as the actuator 414 moves between its said first and second positions. In a preferred arrangement, at least one guide and guiding surface pair, e.g., guided surface 468*b* and guide surface 511*b*, has a non-circular cross section. This non-circular cross section may be square as depicted in FIGS. 8 and 9, and prevents rotational movement between the guided surface 468*b* and guide surface 511*b*, and in turn, prevents rotational movement between the actuator 414 and base 412. Thus, this also prevents undesirable rotational forces to be transferred to the reed 426 and negatively affecting the contact mechanism. The lower compartment 466 and lower permanent magnet 472 may also include a square cross-section if desired. The arrangement as pictured also provides a prominent visual indicator as to the proper end of the actuator 414 that should be inserted into the base 412, which may reduce assembly time and/or prevent an assembly error.

As shown in FIG. 9, the actuator 414 further includes an outwardly depending member 462 for each contact assembly having an outwardly radiating arm 474 and a downwardly depending finger 476 attached thereto. In one preferred embodiment, the outwardly radiating arms 474 are integrally molded with the center body portion 460, and the downwardly depending finger 476 is attached to the arm 476 in a separate step by any conventional method. The downwardly depending fingers 476 include a lower end projection having a slot 477 therein for containing the reed 426. This arrangement permits relative lateral movement between the finger 476 and the reed 426, while still being capable of imparting the necessary vertical force to move the reed 426 with the actuator 414 between its first and second positions.

FIG. 10 illustrates the underside of the bobbin 482 having mechanical pin connectors 484 for providing a mechanical friction connection with the generator coil pins 428 and 430. Each connector 484 includes an electrically conductive pin gripping member 485 and an electrically conductive extension member 487. Pin gripping members 485 are sized and shaped to center the pins 428 and 430 and frictionally retain the pins. Each end, not shown, of the coil 483, may be routed through a respective slot 489 in the lower flange 488 of bobbin 482 and soldered or otherwise attached the extension member 487. This arrangement electrically connects each end of the coil to its respective pin. In a preferred arrangement, the mechanical pin connectors 484 are molded onto the lower flange 488 and extend downwardly therefrom. This provides significant assembly advantages as the final attachment between the pins and the ends of the'coil are made by a simple bobbin 482 insertion step, as opposed to a more time consuming and difficult attachment step.

Further, the lower flange 488 includes a downwardly depending spacer element 491 formed therein. The lower surface 493 of spacer element 491 and the lower surface 495 of extension members 487 act to properly space the bobbin 482 and the RF cover 504 eliminating the need for an upper spacer as shown in FIGS. 1, 2, 6, and 7. Additionally, the base 412 may incorporate an RF shield directly thereon, eliminating the need for a separate RF shield element as shown in FIG. 3. These and other apparent distinctions between the relay shown in FIGS. 8–10 and the relay previously described, e.g., the specific pin location, etc., may also be incorporated into the either relay design.

Figure 11:
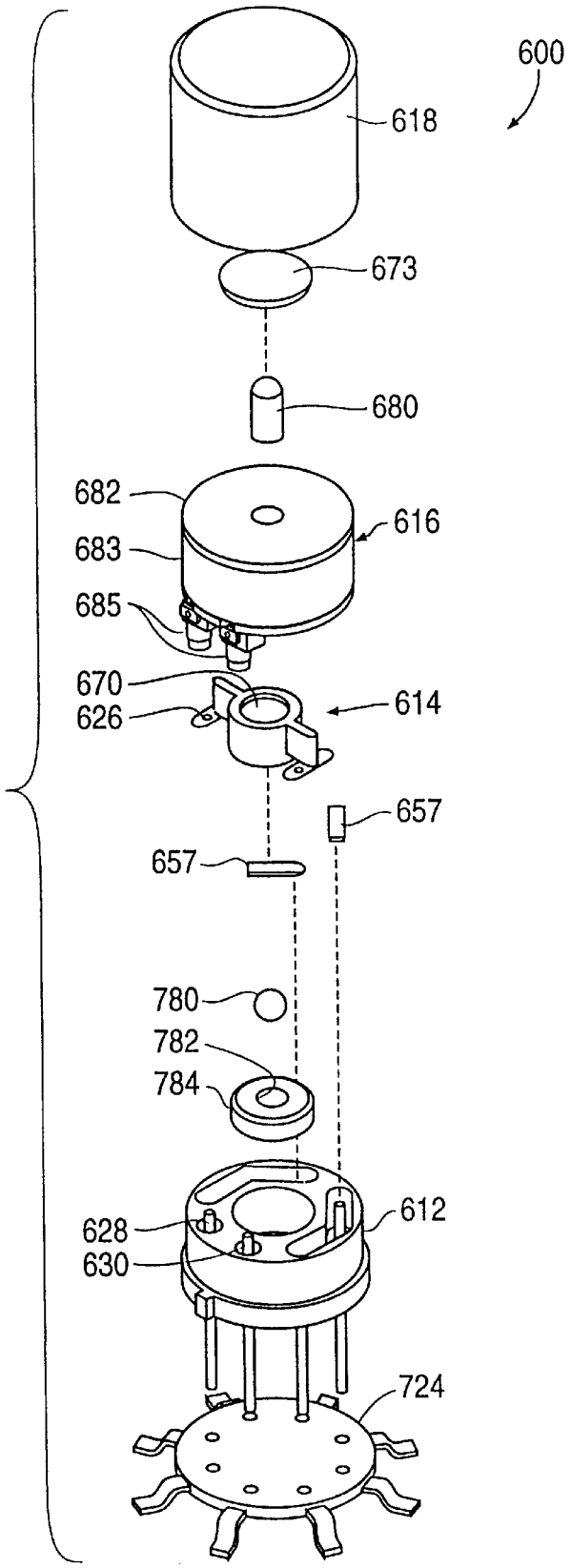
FIG. 11 is an exploded perspective view of another switch similar to that shown in FIGS. 3 and 8, including a few modifications thereto.
Figure 12:
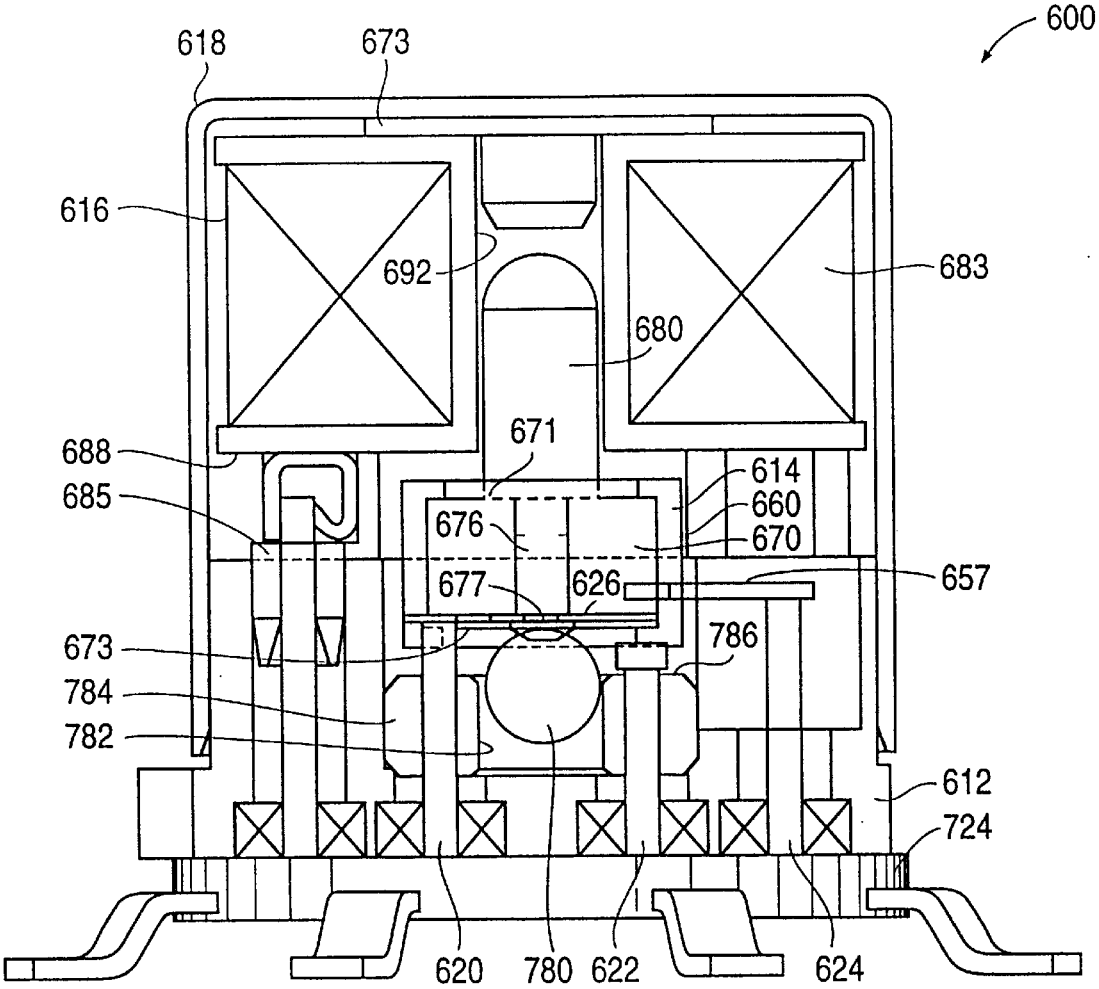
FIG. 12 a schematic cross-sectional view of the switch of FIG. 11 with the actuator shown between its first and second positions.
Figure 13:
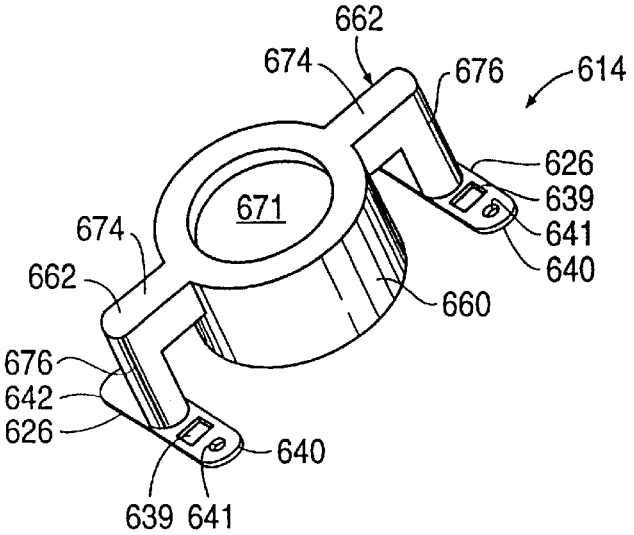
FIG. 13 an enlarged perspective view of the actuator of the switch shown in FIGS. 11 and 12.

Relay 600, as shown in FIGS. 11–13 is similar to the relays shown in FIGS. 1–10 showing some alternative arrangements and some features in more detail. For example, relay 600 is of the latched variety and preferably includes a can 618, a plate 673, a magnetic field generator 616, electrically conductive pin gripping members 685, an actuator 614, a base 612, and an RF cover 704, and can utilize a surface adapter plate 724 for surface mounting applications. It should be noted that any or all of the features of this relay may be incorporated into any of the previously described relays, and any or all of the features of any of the previously described relays may be incorporated into this relay.

As shown in FIGS. 12 and 13, actuator 614 includes a center body portion 660 with a single compartment 664 housing a single central permanent magnet 670. As the embodiment shown includes two sets of circuits being controlled, two outwardly extending members 662 are utilized. Each member 662 includes a generally outwardly depending arm 674, the distal end of each includes a downwardly depending finger 676. The lower end of each finger 676 is coupled to the reed 626 as described above or in any other desirable manner. In one preferred embodiment, the fingers 676 are fixedly attached to the reeds 626, and the center body portion 260, the arms 674, the fingers 676, the permanent magnet 670 and the reeds 626 are integrally molded in a single step to reduce part and assembly costs, e.g., the reeds and magnet are inserted into a mold during the molding process.

Each reed 626 includes a hole 641 at one end 640 for attachment to the top of a input pin 620. As is evident from FIG. 12, movement of the actuator 614 between its first and second positions causes the end 642 of the reeds 626 distal from hole 641 to move into contact with one of two contact pins 622 or 624, either directly or via a horizontal pin extension member 657. Each reed 626 further includes an irregular-shaped hole 639 therein which focuses the bending stresses into a known region which would otherwise be located at the attachment between the reed 626 and the input pin 620, e.g., at a weld joint. The irregular-shaped hole 639 also helps to increase the flexibility of the reed 626 and reduce the amount of force necessary to move the actuator 614.

In this embodiment, guiding of the actuator 614 between its two positions is accomplished by use of an upper plunger or guiding member 680 and a lower guiding member 780 which are respectively magnetically coupled to the upper and lower surfaces 671 and 673 of permanent magnet 670. In the illustrated embodiment, upper guiding member 680 takes the form of a rounded cylindrical rod, while lower guiding member 780 takes the form of a sphere. However, it is recognized that either or both of the magnetically coupled guiding members 680, 780 may take the form of a rounded cylindrical rod, a sphere, or any other viable shape.

In the manner previously described, upper guiding member 680 is guided within the hollow center core of bobbin 682. Lower guiding member 780 is guided within the inner surface 782 of a toriod-like-shaped bushing 784 preferably located in a hollow center region of the base 612. Bushing 784 performs the functions of guiding the lower guiding member 780 and isolating the magnetically fields in regions adjacent the base 612 and the lower guiding member 780 so that the resultant magnetic attraction force between the base 612 and the lower guiding member 780 is always linear, i.e., vertical as shown in the orientation of FIG. 12.

The actuator 784 has a defined specific travel distance of travel enhancing its reliability. This is accomplished by the upper surface 786 of bushing 784 and the lower surface of bobbin flange 688 providing a natural mechanical stop limiting the stroke of the movement of actuator 614.

Lower guiding member 780 is preferably made of the same material as upper guiding member 680, i.e., it preferably includes kovar or iron. Accordingly, lower guiding member 780 takes the place of a lower permanent magnet as shown in FIGS. 1–3, 8, and 9 and provides advantages to this arrangement which are apparent to one of ordinary skill in the art based on the previous description of the upper guiding member or plunger. One such apparent advantage is that the lower guiding member 780 becomes a lower extension to permanent magnet 670 by conducting flux therethrough and attracting actuator 614 to a metal or ferromagnetic portion of the base 612. Further, this arrangement permits lateral movement of the upper and lower guiding members 680, 780 with respect to the permanent magnet 670, and therefore reduces frictional wear and permits less stringent manufacturing tolerances, while still obtaining excellent reliability.

As the design shown in FIGS. 11 and 12 is for a latched relay, the spacing between the upper guiding member 680 and the plate 673, and the lower guiding member 780 and the metallic portion of base 612 and other design criteria are such that in the absence of an applied magnetic field by generator 616, the actuator 614 remains in either its upper position or its lower position. It is recognized that the lower guiding member 780 can be excluded to achieve a "fail-safe" relay in a manner as described above. Thus, this relay can be a fail-safe relay by utilizing the upper guiding member 680 only or can be a latched relay by using both the upper guiding member 680 and lower guiding member 780.

Thus, it is apparent that a new switch has been developed that utilizes a compact drive mechanism which allows the overall package to be small, yet, allowing it to mechanically interface to any system, e.g., direct wire, surface-mount, through-pin connection. This switch creates a physical break in a conductive path that can be generated from an AC, DC, or RF power source. In addition to the switch being able to function in all the known switching configurations, in all these instances, the drive mechanism allows the switch to operate as a fail-safe or a latching switch.

In a preferred arrangement, the base may include a split-level or stepped cavity wherein one set of output pin contacts, e.g., the first output pins, extend above the base at a first level and the other set of pin contacts extend above the base at a second level. This dual-tier cavity may be designed such that the volume of each section is "tuned" to match the geometry of the stationary contacts and the movable reed to produce a constant value impedance path.

It is recognized that a suppression diode or any other well known technique may be used to prevent back or reverse EMF when the magnetic field from the coil collapses when the current applied thereto is removed. Further, if desired, TTL logic or any other well known technique may be used to provide feedback to an external control source.

It should be noted that while the above description was provided referencing the bobbin portion of the relay as the top and the base of the relay as the bottom, these designations were for the purpose of facilitating explanation of the device. In its final configuration, the relay may be in any orientation, i.e., the board to which it is mounted may be in any position. Further, while the explanation of forces applied to the actuator during operation excluded gravitational forces, it is apparent to one skilled in the art the magnetic forces applied to the actuator overcome the gravitational forces and any other miscellaneous forces, regardless of the final orientation of the relay.

While particular embodiments of the invention have been shown and described, it is recognized that various modifications thereof will occur to those skilled in the art. For example, the translation drive mechanism could be designed to move in a curvilinear path in lieu of a linear path. Additionally, the shape of the relay and its can could be square, rectangular, or any other shape, instead of circular to interface with any conventional configuration. Further, the bobbin could be press fit into the can to eliminate the need for any external support. Therefore, the scope of the herein-described invention shall be limited solely by the claims appended hereto.

What is claimed is:

1. An electrically-controlled, electromagnetic switching device for controlling the flow of electrical current between a plurality of terminals, said switching device comprising:

an input terminal;

a first output terminal;

a second output terminal;

a contact element, said contact element movable between a first position which electrically couples the first output terminal and the input terminal, and a second position which electrically couples the second output terminal and the input terminal;

an actuator, said actuator having a body including a permanent magnet, and a ferromagnetic tip member movable with and structurally coupled to said body by a magnetic attraction force between said tip member and said permanent magnet, said actuator structurally coupled to said movable contact element and movable between first and second positions, said movable contact element being in its first position when the actuator is in its first position and said movable contact element being in its second position when the actuator is in its second position;

a magnetic field generator having a hollow centrally-located sleeve and a coil wound around the sleeve in a predetermined direction, said hollow sleeve having a longitudinal center axis defined therein, said tip member of said actuator positioned within the hollow sleeve of the magnetic field generator for movement along said longitudinal center axis, wherein application of electrical current to said coil creates a magnetic field forcing the tip member in a predetermined direction, which moves the actuator, with its tip member, from one of its said first and second positions to the other of its said first and second positions.

2. The switching device of claim 1, wherein said hollow sleeve includes first and second opposing ends and a length defined between the first and second ends of the hollow sleeve, said tip member extending into the hollow sleeve at least 50% of its length from the first end to the second end.

3. The switching device of claim 1, wherein said body includes a housing having a first compartment, said permanent magnet mounted within said first compartment.

4. The switching device of claim 3, further comprising a biasing enabling member, said permanent magnet and said biasing enabling member creating a magnetically induced force therebetween sufficient to move the actuator from its said other position to its said one position and to retain the actuator in said one position in the absence of electrical current being applied to said coil.

5. The switching device of claim 1, wherein said permanent magnet is a first permanent magnet, said body of said actuator further having a second permanent magnet and a housing having a first compartment and a second compartment opposed from said first compartment, said first permanent magnet mounted within said first compartment and said second permanent magnet mounted within said second compartment, said switch further comprising a first biasing enabling member and a second biasing enabling member, wherein application of electrical current to said coil in a first direction creates a magnetic field moving the actuator from its said one position to its said other position, the application of electrical current to said coil in a direction opposite from said first direction creates a magnetic field moving the actuator from its said other position to its said one position, said first permanent magnet and said first biasing enabling member creating a magnetic force therebetween to retain said actuator in its said one position in the absence of electrical current being applied to said coil, and said second permanent magnet and said second biasing enabling member creating a magnetic force therebetween to retain said actuator in its said other position in the absence of electrical current being applied to said coil.

6. The switching device of claim 1, wherein said actuator body includes a generally cylindrical body, said actuator further including an arm extending laterally outward of said body and a finger extending downwardly from said arm, said finger being fixedly attached to said movable contact element.

7. The switching device of claim 6, further comprising a spacer having a first aperture and a second aperture therein, said first and second apertures being generally parallel to said longitudinal axis, when said actuator body is positionable and movable within said first aperture and said finger is positionable and movable within said second aperture.

8. The switching device of claim 7, wherein said spacer comprises an RF shield having a predetermined impedance functionally related to predetermined characteristics of the contact element.

9. The switching device of claim 8, wherein said RF shield is comprised of an outer metallic surface to create said predetermined impedance.

10. The switching device of claim 1, further comprising a pin holding assembly and a surface mount adapter member, said pin holding assembly including said input terminal, said first output terminal and said second output terminal, said surface mount adaptor member including a plate and a plurality of spaced mounting legs vertically spacing said plate from an intended mounting surface, each said terminal electrically connected to a mounting leg.

11. The switching device of claim 1, wherein said magnetic field generator is substantially void of a stationary ferromagnetic member in its hollow sleeve.

12. The switching device of claim 1, wherein said hollow sleeve of said magnetic field generator is non-ferromagnetic.

13. The switching device of claim 1, wherein said actuator includes a non-circular guided surface, said switching device further including a non-circular guide surface shaped substantially similar to said guided surface, said guide surface guiding said guided surface and preventing rotational movement therebetween when said actuator moves between its said first and second positions.

14. An electrically-controlled, electromagnetic switching device for controlling the flow of electrical current between terminals, said switch comprising:

a base;

an input pin;

a first output pin;

a second output pin;

said input, first output, and second output pins being fixed to, and mounted substantially perpendicular to said base;

a movable reed, said movable reed electrically coupled to the input pin and being movable between a first position wherein the first output pin is electrically coupled to said input pin, and a second position wherein the second output pin is electrically coupled to said input pin;

an actuator, said actuator includes a center body portion, a permanent magnet attached to said center body portion, an arm integrally molded with said center body portion and extending generally laterally outward from said center body portion, and a finger depending downwardly from said arm, said finger structurally coupled to said movable reed, said actuator movable between first and second positions and being structurally coupled to said movable reed such that the movable reed is in its first position when the actuator is in its first position and the movable reed is in its second position when the actuator is in its second position;

a magnetic field generator having a hollow centrally located sleeve and a coil wound around the sleeve in a predetermined direction, wherein application of electrical current through said coil creates a magnetic field to move the actuator from its said first position to its said second position.

15. The switching device of claim 14, wherein the finger is integrally molded with said arm and said center body portion.

16. The switching device of claim 15, wherein said finger includes a reed retaining sleeve, said reed retaining sleeve closely surrounding said movable reed to permit relative movement therebetween while providing a sufficient force thereto to move the movable reed between said first and second positions.

17. An electrically-controlled, electromagnetic switching device for controlling the flow of electrical current between a plurality of terminals, said switching device comprising:

a base;

an input terminal extending through the base;

a first output terminal extending through the base;

a second output terminal extending through the base;

a contact element, said contact element movable between a first position which electrically couples the first output terminal and the input terminal, and a second position which electrically couples the second output terminal and the input terminal;

an actuator fixedly coupled to said movable contact element to move said contact element between said first and second positions, said actuator including a ferromagnetic portion;

a magnetic field generator, said magnetic field generator including a sleeve having an outer surface and upper and lower ends, an upper flange extending laterally outward from the sleeve at the upper end, a lower flange extending laterally outward from the sleeve at the lower end, and a coil having first and second ends, said coil wound around the outer surface of the sleeve between the upper and lower flanges in a predetermined direction;

a first plug extending through the base;

a second plug extending through said base;

a first receptacle attached to said first end of said coil and frictionally receiving said first plug electrically connecting said first plug with said first end of the coil; and a second receptacle attached to said second end of said coil and frictionally receiving said second plug electrically connecting said second plug with said second end of the coil;

wherein electrical current applied to said first plug travels to said second plug, via said coil, creating a magnetic field to move the actuator from its said first position to its said second position.

18. The switching device of claim 17, wherein said first and second receptacles are directly attached to said lower flange of said magnetic field generator.

19. The switching device of claim 18, wherein said first and second receptacles extend downwardly from said lower flange of said magnetic field generator and are molded thereto.

20. The switching device of claim 17, wherein said actuator moves along a longitudinal axis between its said first and second positions, said first and second plugs oriented substantially parallel to said longitudinal axis.

21. The switching device of claim 20, said sleeve having an axis geometrically centered therewithin, said geometrically centered axis being coextensive with said longitudinal axis.

22. The switching device of claim 21, wherein a portion of said actuator moves within said sleeve and along said longitudinal axis.

23. The switching device of claim 17, wherein said base includes a lower side and a plurality of apertures therein, said switching device further comprising a mounting adapter, said mounting adapter positioned at the lower side of said base and having a body including a plurality of apertures and mounting members extending from said body, each said aperture in said mounting adapter body superimposed below a respective aperture in said base, each said mounting member having a mounting portion permitting the surface mounting of the switching device, and a spacing portion vertically offsetting said mounting portion with respect to said body, each said terminal and each said plug extending through a respective aperture in said mounting adapter body and a respective aperture in said base, affixed with respect to the mounting adapter body, and electrically coupled to a respective mounting member.

24. A switching device for controlling the flow of electrical current between a plurality of terminals, said switching device comprising:

a base, said base including a lower side, an upper side, and a plurality of apertures therein;

a plurality of electrically conductive shafts, said plurality of shafts including at least an input shaft, a first output shaft, and a second output shaft, each said shaft extending through a respective aperture, and attached and electrically insulated with respect to said base;

a switching mechanism, said switching mechanism electrically coupling the first output shaft and the input shaft when under a first set of predetermined conditions and electrically coupling the second output shaft and the input shaft when under a second set of predetermined conditions; and a mounting adapter, said mounting adapter positioned at the lower side of said base and having a body including a plurality of apertures and mounting members extending from said body, each said aperture in said mounting adapter body superimposed below a respective aperture in said base, each said mounting member having a mounting portion permitting the surface mounting of the switching device, and a spacing portion vertically offsetting said mounting portion with respect to said body, each said shaft extending through a respective aperture in said mounting adapter body, affixed with respect to the mounting adapter body, and electrically coupled to a respective mounting member.

25. The switching device of claim 24, wherein each said shaft is fixedly attached and electrically coupled to its respective mounting member at its respective mounting adapter aperture.

26. The switching device of claim 25, each said mounting members extending to its respective mounting adapter aperture electrically connecting each said mounting member to its respective shaft at its respective aperture on the mounting adapter.

27. The switching device of claim 26, said mounting members extending outward from said mounting adapter body.

28. The switching device of claim 27, wherein said mounting members are electrically isolated from one another.

29. The switching device of claim 28, further comprising a dielectric compatible plastic material located in said apertures of said base structurally retaining the shafts with respect to the base, preventing undesired movement of the shafts with respect to the base, and electrically insulating said shafts with respect to said base.

30. The switching device of claim 25, wherein each said shaft is directly fixedly attached to said adapter member.

31. The switching device of claim 30, further comprising welds directly fixedly attaching each said shaft to said adapter member.

32. A switching device for controlling the flow of electrical current between a plurality of terminals, said switching device comprising:

a base, said base including a plurality of apertures therein;

a plurality of electrically conductive shafts, said plurality of shafts including at least an input shaft, a first output shaft, and a second output shaft, each shaft extending through an aperture in said base;

a switching mechanism, said switching mechanism electrically coupling the first output shaft and the input shaft when under a first set of predetermined conditions and electrically coupling the second output shaft and the input shaft when under a second set of predetermined conditions; and dielectric compatible plastic material, said dielectric compatible plastic material located in said apertures structurally retaining the shafts therein, preventing undesired movement of the shafts with respect to the base, and electrically insulating said shafts with respect to said base.

33. The switching device of claim 32, wherein said dielectric plastic material has a dielectric constant in the range between 3.0 and 3.5.

34. The switching device of claim 33, wherein said dielectric plastic material includes polyphenylene sulfide.

35. The switching device of claim 1, wherein said tip member is a first tip member, said permanent magnet includes a first and second opposing surfaces, said switching device further including a second ferromagnetic tip member, said first tip member structurally coupled to said body by a magnetic attraction force between said first tip member and said permanent magnet, said second tip member structurally coupled to said body by a magnetic attraction force between said second tip member and said permanent magnet, said first tip member contacting said first surface of said permanent magnet and said second tip member contacting said second surface of said permanent magnet, said switch further comprising a first biasing enabling member and a second biasing enabling member, wherein application of electrical current to said coil in a first direction creates a magnetic field moving the actuator from its said one position to its said other position, the application of electrical current to said coil in a direction opposite from said first direction creates a magnetic field moving the actuator from its said other position to its said one position, said first tip member, said permanent magnet and said first biasing enabling member creating a magnetic force therebetween to retain said actuator in its said one position in the absence of electrical current being applied to said coil, and said second tip member, said permanent magnet and said second biasing enabling member creating a magnetic force therebetween to retain said actuator in its said other position in the absence of electrical current being applied to said coil.

36. The switching device of claim 35, further comprising an toroidal-shaped member guiding said second tip member and magnetically isolating regions proximate to the second tip member.

37. The switching device of claim 1, wherein said tip member is spherical.

* * * * *